US007174906B2

(12) United States Patent
Ko

(10) Patent No.: US 7,174,906 B2
(45) Date of Patent: Feb. 13, 2007

(54) FOLDABLE UMBRELLA FRAME HAVING SIX RIBS

(76) Inventor: Chin-Sung Ko, No. 38, Din Nan Road, Homei Town, Changhua Shien (TW)

( * ) Notice: Subject to any disclaimer, the term of this patent is extended or adjusted under 35 U.S.C. 154(b) by 30 days.

(21) Appl. No.: 10/994,322

(22) Filed: Nov. 23, 2004

(65) Prior Publication Data

US 2006/0118151 A1 Jun. 8, 2006

(51) Int. Cl.
*A45B 19/10* (2006.01)
*A45B 25/02* (2006.01)

(52) U.S. Cl. ..... 135/25.3; 135/32; 135/31

(58) Field of Classification Search .... 135/25.1–25.32, 135/25.34, 29, 31–32; D3/5–7, 10
See application file for complete search history.

(56) References Cited

U.S. PATENT DOCUMENTS

| | | | | |
|---|---|---|---|---|
| 5,085,239 | A * | 2/1992 | Chin-Hung et al. | 135/25.33 |
| 5,553,634 | A * | 9/1996 | Yang | 135/25.3 |
| 6,062,242 | A * | 5/2000 | Lin | 135/31 |
| 6,230,725 | B1 * | 5/2001 | Ko | 135/31 |
| 6,244,284 | B1 * | 6/2001 | Wang | 135/31 |
| 6,655,398 | B2 * | 12/2003 | Huang | 135/29 |
| D484,680 | S * | 1/2004 | You | D3/10 |

* cited by examiner

*Primary Examiner*—Winnie Yip
(74) *Attorney, Agent, or Firm*—Rosenberg, Klein & Lee

(57) ABSTRACT

The invention relates to a foldable umbrella frame having six ribs, wherein the first rib, the second rib, the third rib, and the fourth rib are formed to be solid rods with outer flat portion. The ribs are pivoted to form a frame. Branch ribs have inner hooks to connect with outer flat portion of respective rib that provides a small volume of the umbrella in closed state for facilitating carrying by users.

2 Claims, 4 Drawing Sheets

FOLDABLE UMBRELLA FRAME HAVING SIX RIBS

FIELD OF THE INVENTION

The present invention relates to a foldable umbrella frame having six ribs, which is particularly about an improvement of a six-folded umbrella.

BACKGROUND OF THE INVENTION

Generally, a six-folded umbrella is an umbrella having six ribs to assemble the frame that obtains a small volume for facilitating carrying by users. As shown in FIG. 1, each of the conventional umbrella frames (1) includes a first rib (11), a second rib (12), a third rib (13), a fourth rib (14), a fifth rib (15), and a tail rib (16). It is known that the first rib (11), the second rib (12), the third rib (13), and the fourth rib (14) are usually formed to have a U-shaped cross-section and the ribs are pivoted with each other. When the conventional umbrella is closed as shown in FIG. 2, the ribs will be resistant against others and make the frame (1) be slightly expanded. Accordingly, the six-folded umbrella has a short length but has a large diameter. The volume of the collapsible umbrella in closed state is still large and it is not very convenient for carrying.

SUMMARY OF THE INVENTION

The present invention is to provide a six-folded umbrella having six ribs, wherein the ribs are improved to overcome the drawback of the conventional one. Hence, the improved umbrella can provide a small volume for facilitating carrying. Now, accompanying with the following drawings, the character of the present invention will be described here and after.

DETAILED DESCRIPTION OF THE PREFERRED EMBODIMENT

Figure 1:
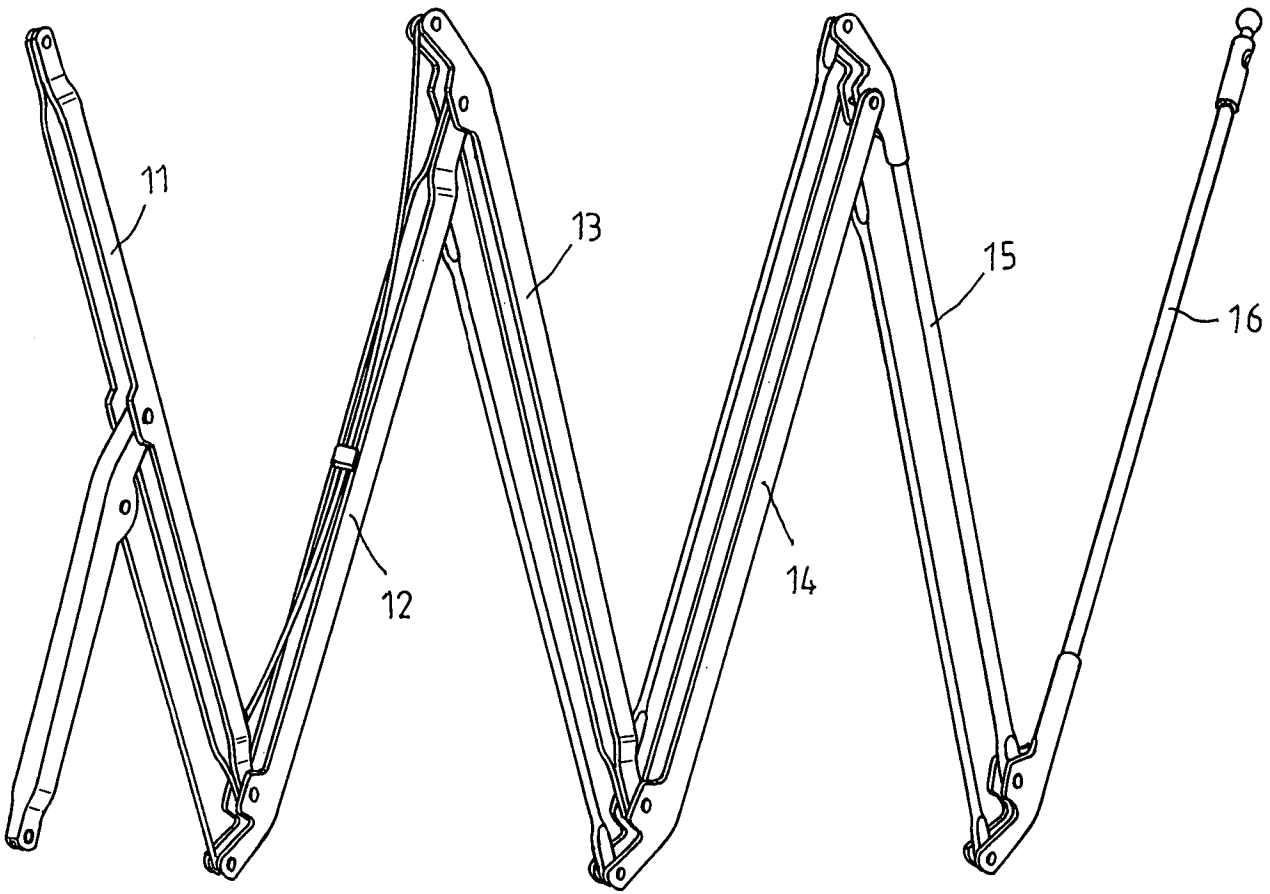
FIG. 1 (prior art)
FIG. 1 is a plan view showing a single frame of a convention six-folded umbrella.
Figure 2:
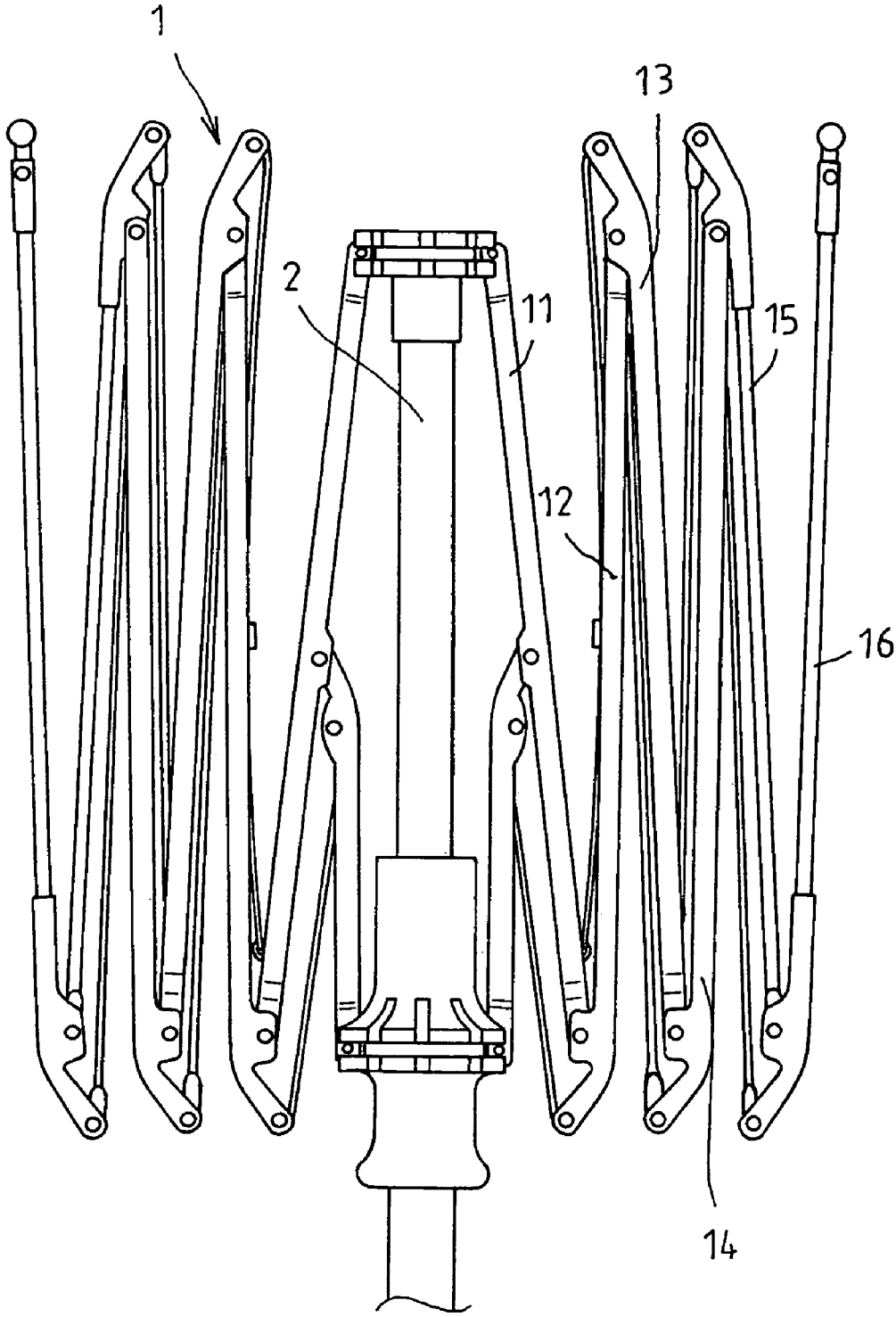
F I G. 2 (prior art)
FIG. 2 is a plan view showing a conventional six-folded umbrella in closed state.
Figure 3:
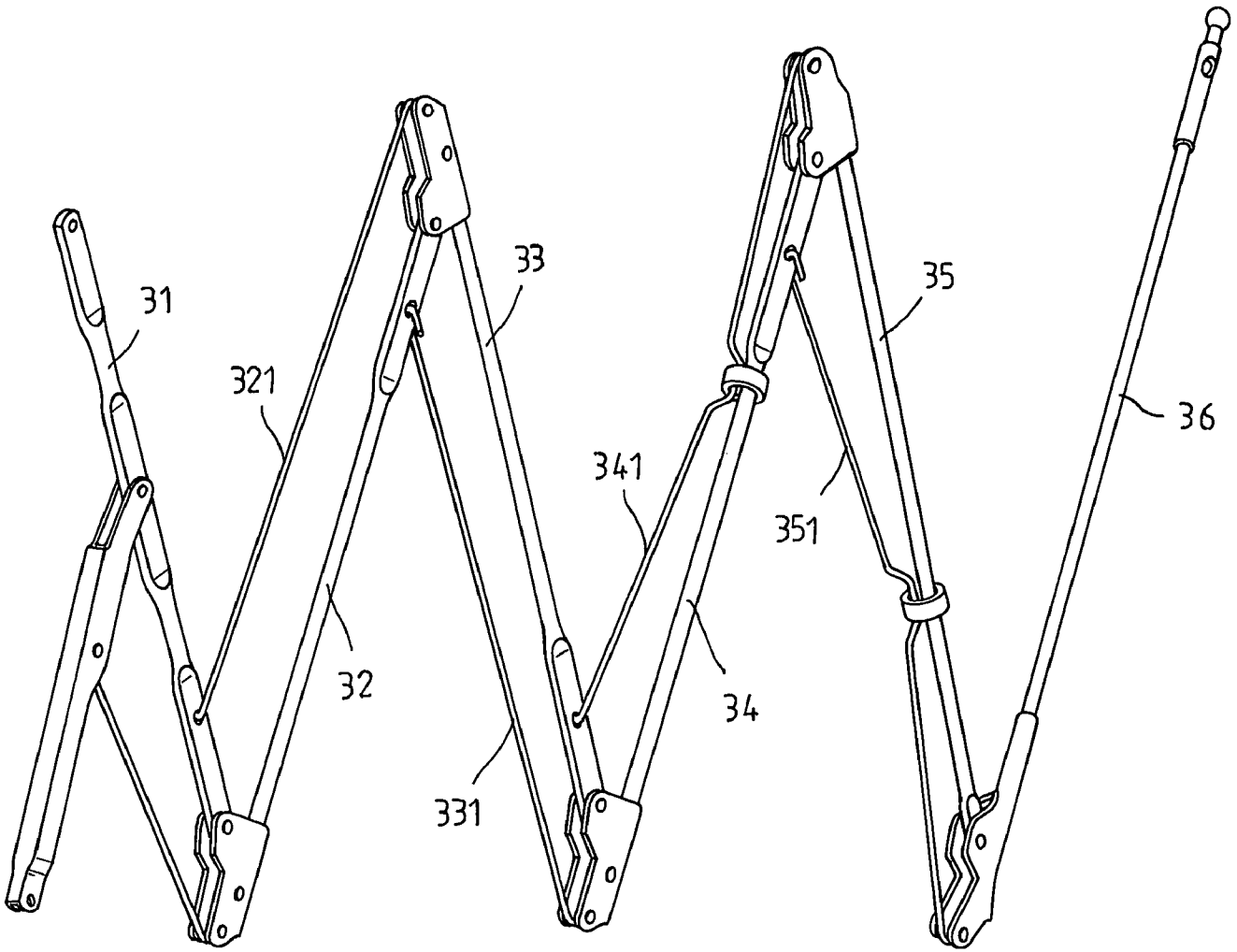
FIG. 3 is a plan view showing a single frame having six ribs according to the present invention.
Figure 4:
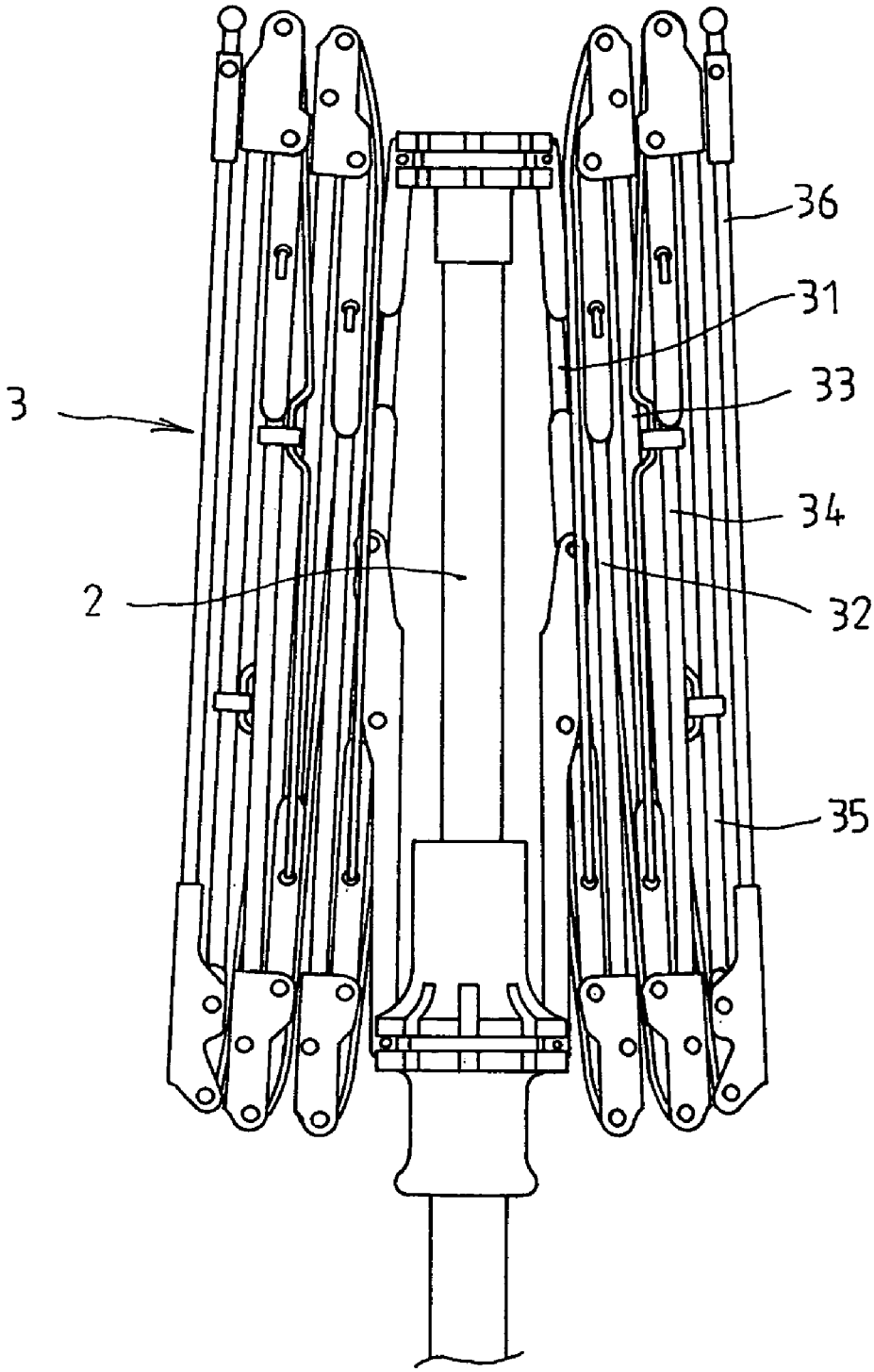
FIG. 4 is a plan view showing a six-folded umbrella in closed state according to the present invention.

The present invention is to provide an improvement about a six-folded umbrella. Please refer to FIG. 3 and 4, it shows a foldable six-folded umbrella, which includes a first rib (31), a second rib (32), a third rib (33), a fourth rib (34), a fifth rib (35), and a tail rib (36) to assemble a frame (3). The characteristic of the present invention is the first rib (31), the second rib (32), the third rib (33), and the fourth rib (34) are formed to be solid ribs, wherein the first rib (31) has its both ends and middle portion to be flat structure while the second rib (32), the third rib (33), and the fourth rib (34) have their outer end to be flat. The umbrella of this invention also includes a second branch rib (321), a third branch rib (331), a fourth branch rib (341), and a fifth branch rib (351), all of which have inner hook for connecting with outer flat portion of the first rib (31), the second rib (32), the third rib (33), and the fourth rib (34) respectively. Hence, the umbrella according to the present invention has a small volume as it is closed since the flat portions avoid resistance between the ribs.

Above all, the present invention mainly improves the structure of umbrella ribs and their connecting structures. It provides a small volume of the six-folded umbrella in closed state that obtains the improvement and utilization.

I claim:

1. A foldable umbrella frame comprising:

a substantially flat first rib having substantially flat first and second ends;

a second rib having a solid body and a first end and a substantially flat second end, said second rib pivotally coupled to said second end of said first rib at said first end thereof;

a third rib having a solid body and a first end and a substantially flat second end, said third rib pivotally coupled to said substantially flat second end of said second rib at said first end thereof;

a fourth rib having a solid body and a first end and substantially flat second end, said fourth rib pivotally coupled to said substantially flat second end of said third rib at said first end thereof;

a fifth rib having a solid body and being pivotally coupled to said substantially flat second end of said fourth rib at a first end thereof; and, a sixth rib having a solid body and being pivotally coupled to a second end of said fifth rib at a first end thereof.

2. The foldable umbrella as recited in claim 1, further comprising four branch ribs respectively coupled to said substantially flat second ends of said first, second, third and fourth ribs.

* * * * *